US008884768B2

(12) United States Patent
Alsaffar

(10) Patent No.: US 8,884,768 B2
(45) Date of Patent: Nov. 11, 2014

(54) PORTABLE ALARM SYSTEM FOR COFFINS

(71) Applicant: Abdulreidha Abdulrasoul Alsaffar, Mubarak Alkabeer (KW)

(72) Inventor: Abdulreidha Abdulrasoul Alsaffar, Mubarak Alkabeer (KW)

( * ) Notice: Subject to any disclaimer, the term of this patent is extended or adjusted under 35 U.S.C. 154(b) by 13 days.

(21) Appl. No.: 13/736,010

(22) Filed: Jan. 7, 2013

(65) Prior Publication Data

US 2014/0189988 A1 Jul. 10, 2014

(51) Int. Cl.

*G08B 23/00* (2006.01)
*G08B 21/00* (2006.01)
*A62B 33/00* (2006.01)

(52) U.S. Cl.

CPC ..... *A62B 33/00* (2013.01); *G08B 21/00* (2013.01)
USPC ..... 340/573.1; 340/575; 340/539.1; 27/31

(58) Field of Classification Search

CPC .... G08B 7/064; G08B 21/0469; G08B 23/00; G08B 25/00; G08B 21/0453; G08B 21/0461; G08B 21/22; A61G 17/00
USPC ..... 340/573.1, 575, 539.1, 540; 27/2, 31; 116/67 R; 251/129.03; 174/37
See application file for complete search history.

(56) References Cited

U.S. PATENT DOCUMENTS

| | | | | |
|---|---|---|---|---|
| 766,171 | A | 8/1904 | Crosby et al. | |
| 925,260 | A * | 6/1909 | Zimmermann | 27/31 |
| 4,367,461 | A * | 1/1983 | Gauchard | 340/573.1 |
| 7,765,656 | B2 * | 8/2010 | Dannenberg | 27/31 |
| 2003/0208890 | A1 * | 11/2003 | Kim | 27/31 |
| 2012/0105237 | A1 * | 5/2012 | Kwong | 340/635 |

FOREIGN PATENT DOCUMENTS

| | | |
|---|---|---|
| GB | 2 113 439 A | 8/1983 |
| WO | WO 85/03235 | 8/1985 |

* cited by examiner

*Primary Examiner* — Anh V La
(74) *Attorney, Agent, or Firm* — Richard C. Litman

(57) ABSTRACT

The portable alarm system for coffins is a system that enables a person who has been mistakenly interred to transmit a signal that indicates that he/she is alive. The system includes a signal transmitting structure removably secured in the coffin or tomb. A lamp or light source provides illumination for the tomb or coffin to allay the effect of panic for the entombed person. A receiving device is located in a prominent place, whereby the transmitted signal may be readily and quickly observed by security or other personnel. After a predetermined period, the system can be easily removed from the coffin for reuse.

10 Claims, 7 Drawing Sheets

PORTABLE ALARM SYSTEM FOR COFFINS

BACKGROUND OF THE INVENTION

1. Field of the Invention

The present invention generally relates to alarm systems, and particularly to a portable alarm system for coffins that provides an alarm system for emitting a signal to indicate that a person has been mistakenly presumed dead and has been buried while alive.

2. Description of the Related Art

Being buried prematurely is arguably one of the most terrifying of all human fears. History abounds with documented stories of people, whose vital signs being undetectable, are presumed to be deceased and are interred (without embalming) while still alive. One can only imagine the horror and panic that occurs if one awakes to find that he/she is trapped in the darkened and confined area of a tomb or coffin. Mistaken declarations of death are often discovered when the embalming process is initiated. However, many societies have religious tenets that require that the remains of the deceased must be interred within a certain time period, e.g., 24-48 hours. In such instances, embalming may not occur and the chance of premature burial is increased. Premature burial usually leads to death in a very short time (1-2 hours) because of one or a combination of the following: asphyxiation, dehydration, starvation or hypothermia. However, if a suitable amount of oxygen is available, survival could be in the order of a few days, barring serious injury.

The burial industry abounds with many devices that are geared to prevent premature burial. Unfortunately, these devices have proven to be unreliable and/or inefficient. The industry would certainly embrace a reliable device for detecting an incidence of premature burial. Thus, a portable alarm system for coffins solving the aforementioned problems is desired.

SUMMARY OF THE INVENTION

The portable alarm system for coffins is a portable system that enables a person who has been mistakenly interred to transmit a signal that indicates that he/she is alive. The system includes a signal-transmitting structure removably secured in the coffin or tomb. A lamp or light source provides illumination in the tomb or coffin to allay the effect of panic for the entombed person. A receiving device is located in a prominent place, whereby the transmitted signal may be readily and quickly observed by security or other personnel. After a predetermined period, e.g., 4-7 days, the system can be easily removed from the coffin for reuse.

Accordingly, the invention presents an alarm system that provides means for a person mistakenly interred to initiate an alarm upon awakening. The alarm system is reliable, efficient, simple in operation, and reusable. The invention provides for improved elements thereof in an arrangement for the purposes described that are inexpensive, dependable and fully effective in accomplishing their intended purposes.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
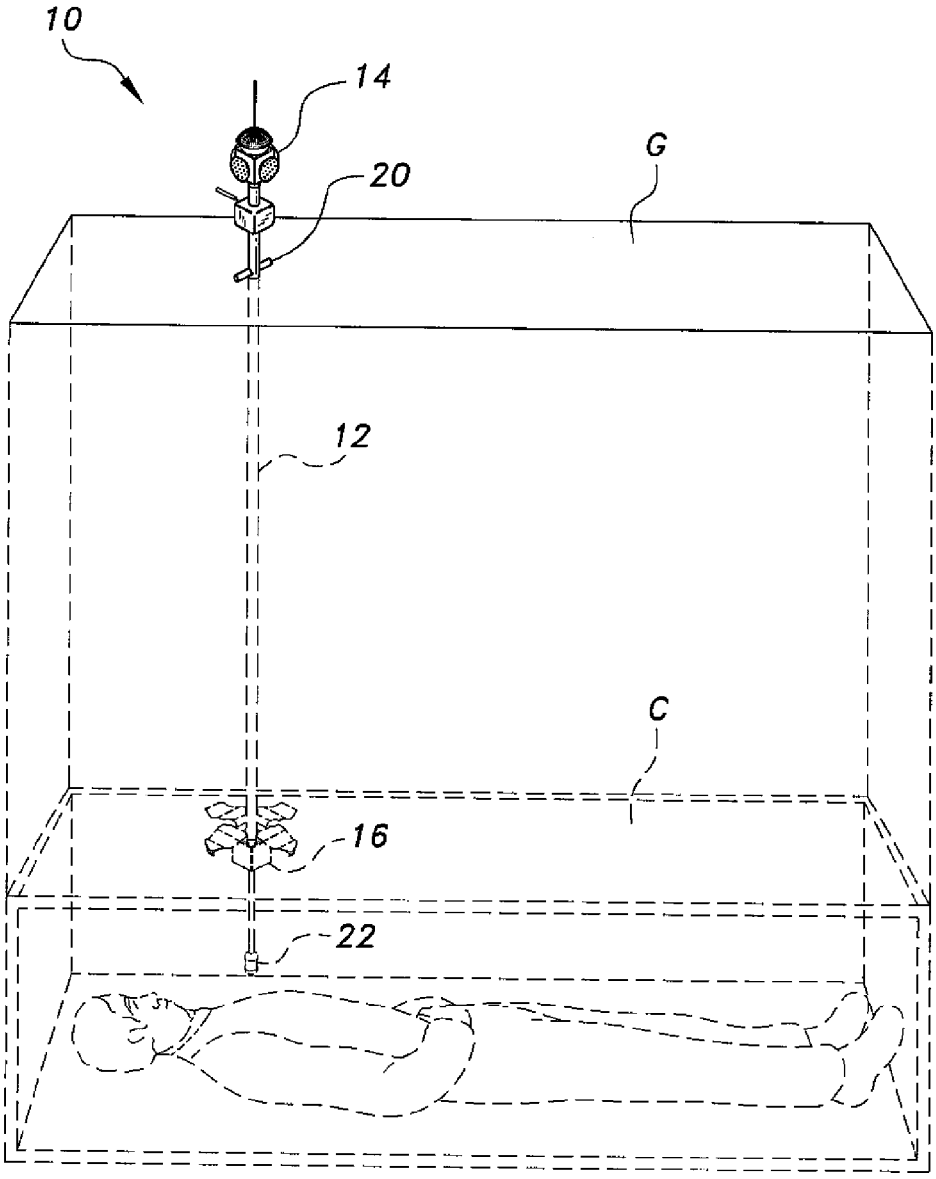
FIG. 1 is an environmental perspective view of an alarm system for coffins according to the present invention.
Figure 2:
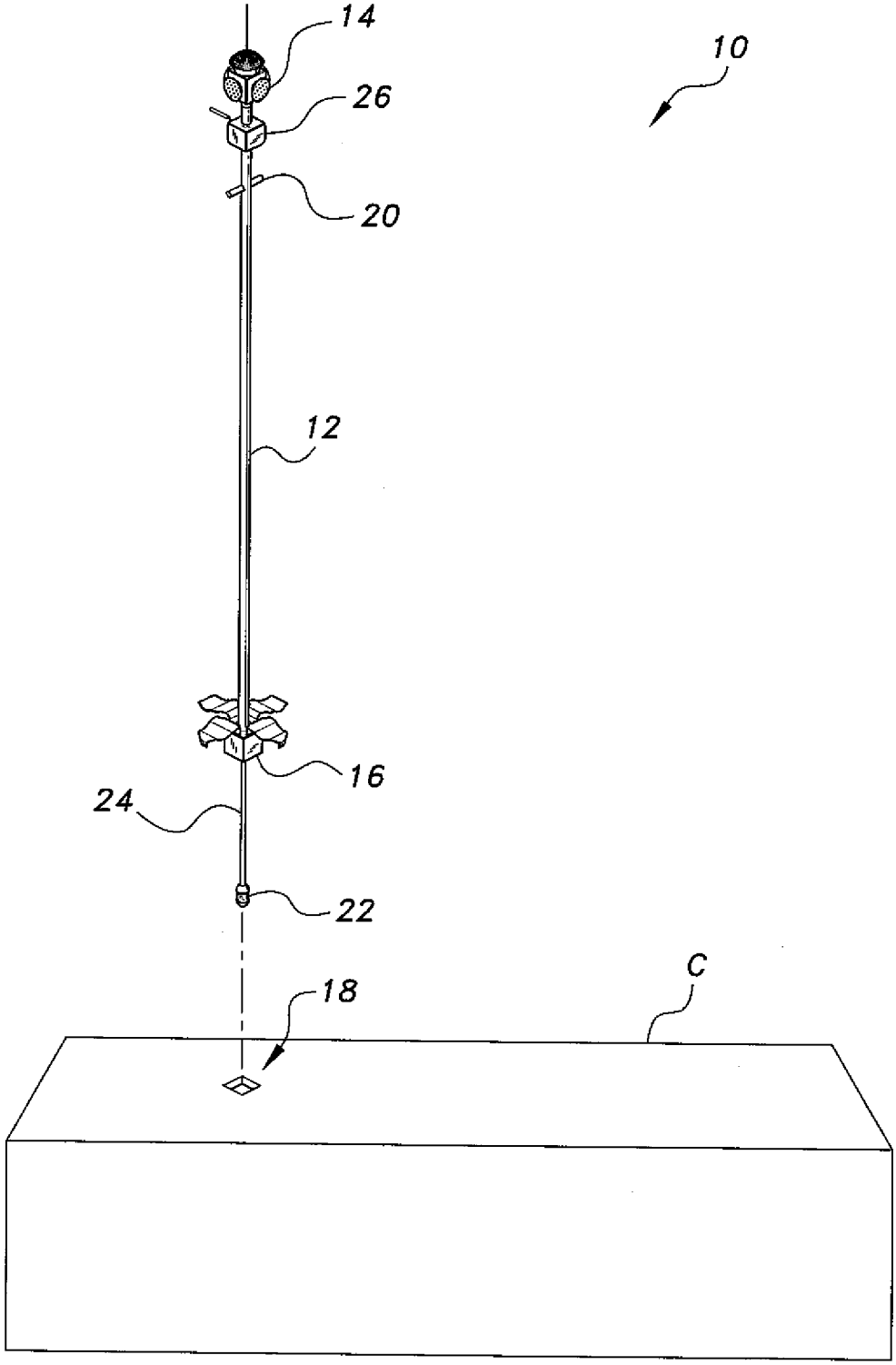
FIG. 2 is a partially exploded perspective view of an alarm system for coffins according to the present invention.
Figure 3:
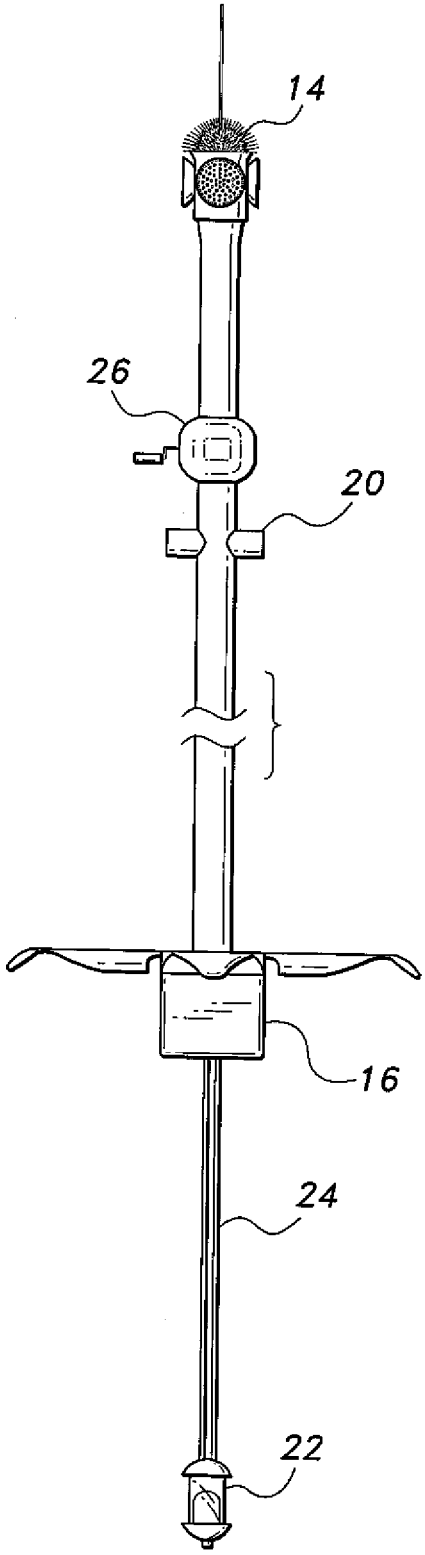
FIG. 3 is a front view of the portable transmitter support structure of an alarm system for coffins according to the present invention.

Referring to FIGS. 1-3, the transmitting structure of the portable alarm system for coffins is generally indicated at 10. The transmitting structure 10 comprises an elongate, hollow shaft 12 having upper and lower ends. A transmitting unit 14 (preferably battery-powered) defines the upper end of the shaft 12. A lamp box 16 is attached to the lower end of the shaft 12. The shaft 12 is adapted to extend through the ground G. An opening 18 is provided in the top of the coffin C to receive the lamp box 16 therethrough. A surface rod 20 is provided on the shaft 12 to be positioned at ground level when the structure is in place. A lamp 22 is supported on a pair of wires 24 and is extendable from the lamp box 16. The wires 24 extend through the shaft 12 and terminate at a roller housing 26 for reasons explained below. As presently contemplated, the shaft 12 is approximately 2.5 meters in length.

Figure 4A:
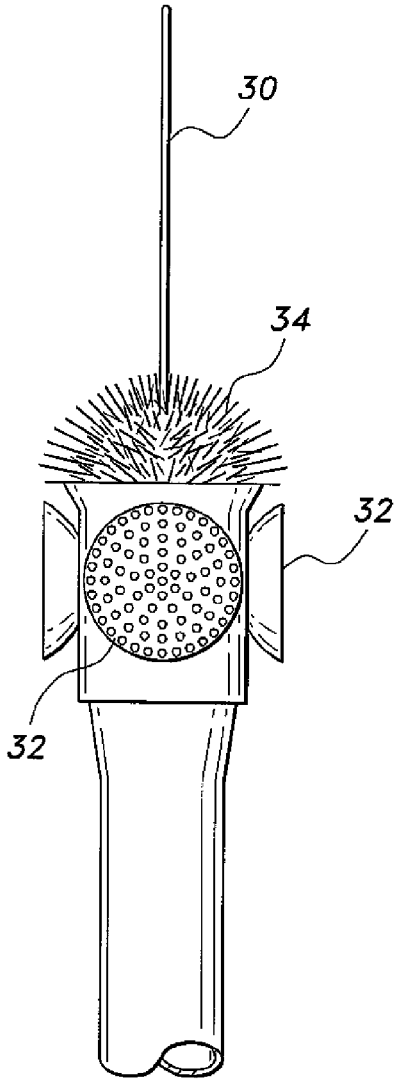
FIG. 4A is a partial front view showing details of the transmitter of a portable alarm system for coffins according to the present invention.
Figure 4B:
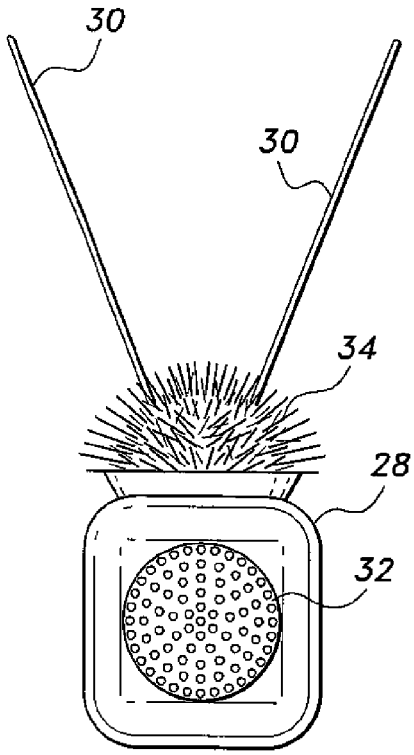
FIG. 4B is a front view of the receiver of a portable alarm system for coffins according to the present invention.
Figure 5:
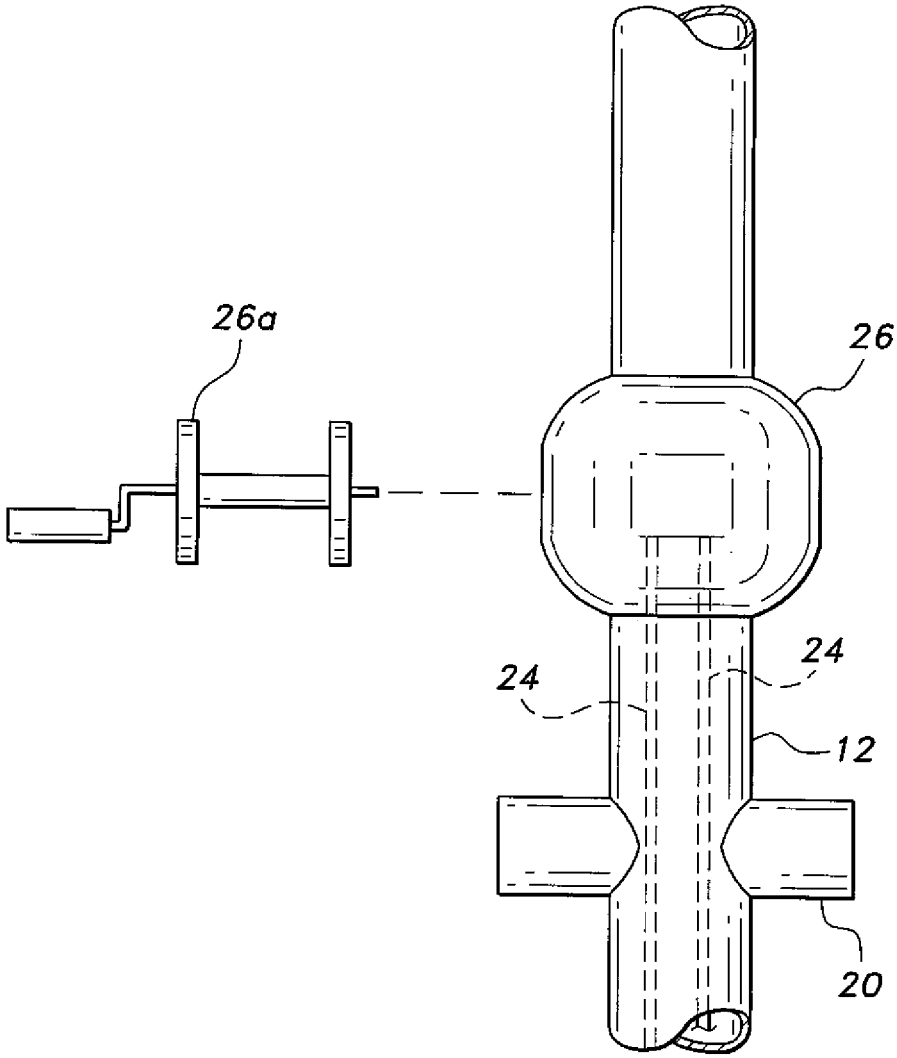
FIG. 5 is a partial front view showing the ground post and retrieving tool of a portable alarm system for coffins according to the present invention.

FIGS. 4A and 4B show details of the transmitting unit 14 and of a receiving unit 28. Both units are provided with a wireless antenna 30, speakers 32 or other transducers for annunciating audible alarms, and visual alerts 34 in the form of flashing lights. The receiving unit 28 will be disposed in a prominent location where it can be readily monitored by security personnel. As best seen in FIG. 5, a roller housing 26 includes a reel 26*a* or motor for initiating the extraction procedure, as explained below.

Figure 6:
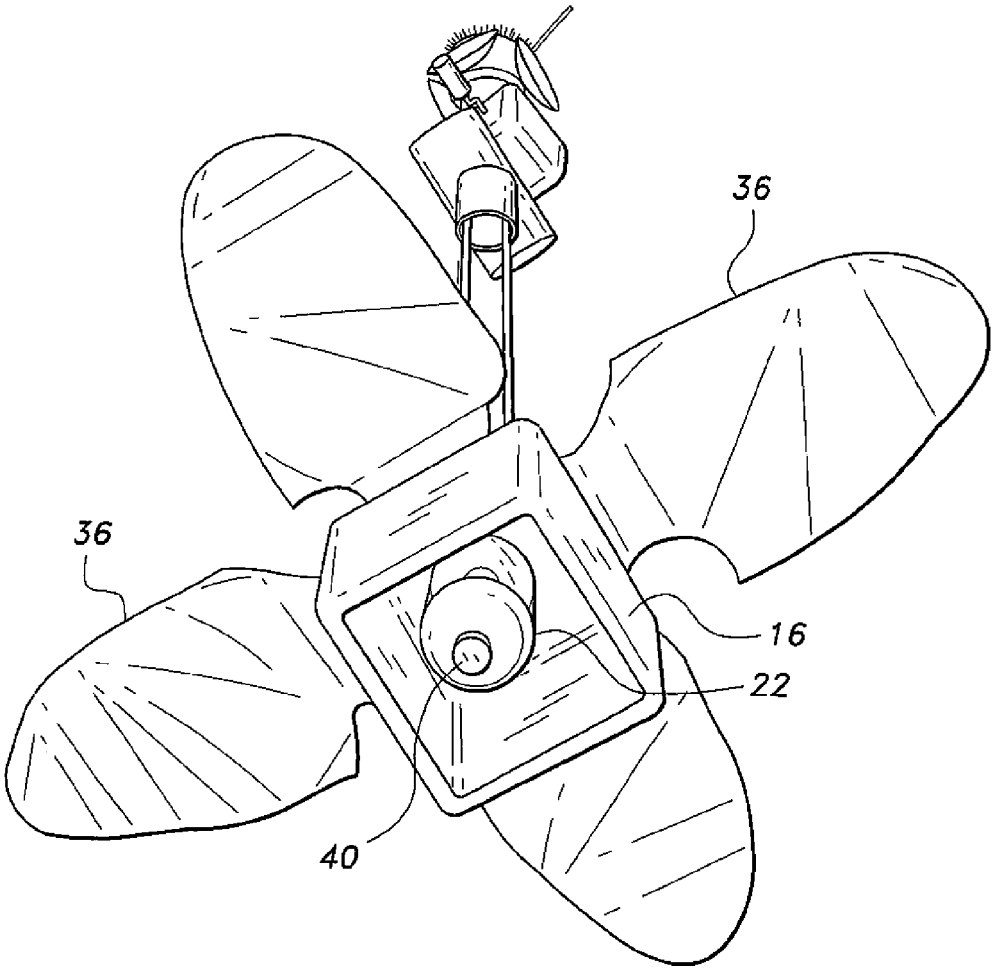
FIG. 6 is a bottom, perspective view of a lamp box in a portable alarm system for coffins according to the present invention.
Figure 7A:
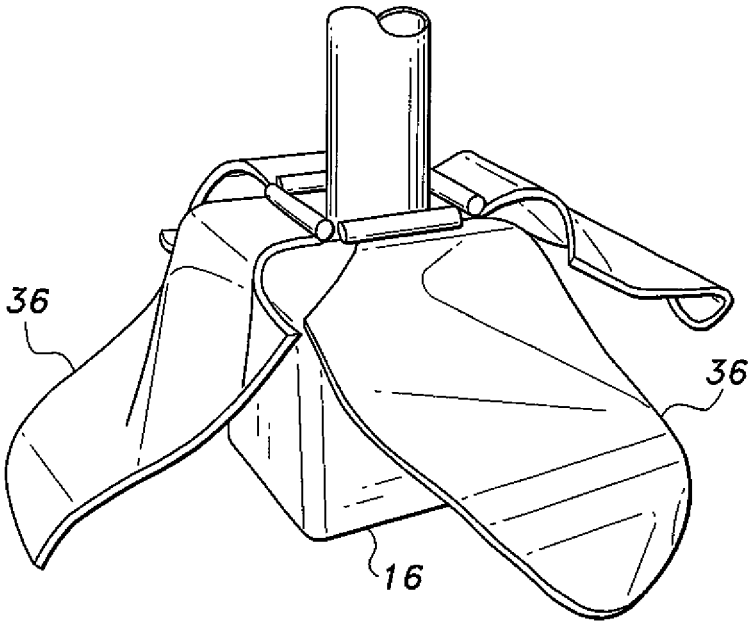
FIG. 7A is a partial perspective view of a portable alarm system for coffins according to the present invention, showing the lamp box with the metal barriers open.
Figure 7B:
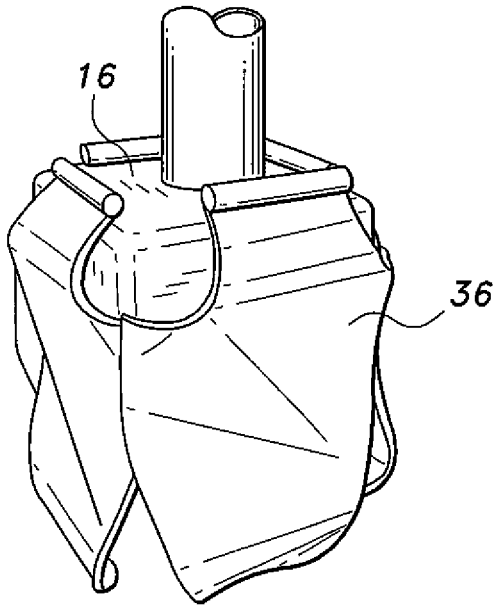
FIG. 7B is a partial perspective view of a portable alarm system for coffins according to the present invention, showing the lamp box with the metal barriers closed.

As best seen in FIGS. 6, 7A, and 7B, a plurality of metal appendages 36 are mounted on the lamp box 16 for pivoting movement. A switch or button 40 for initiating or triggering the alarm, including the audible and visual alarms at both the transmitter 14 and the receiver 28, is disposed at the lower end of the lamp 22. FIG. 7A shows the appendages 36 in an open position, while FIG. 7B shows the appendages in a folded position.

In use, the lamp box 16 is inserted through the opening 18 in the coffin C, and may be vacuumed sealed therein. The metal appendages 36 are in an open position and abut the top of coffin C. The lamp 22 is extended to a position near the presumed corpse, as shown in FIG. 1. In some instances, the lamp 22 may be positioned in the hand of the presumed corpse. The coffin C is placed in a prepared excavation, and the excavation is filled with earth, as is conventional. The length of the shaft 12 is such that the surface rod 20 will be positioned adjacent the surface of the ground. The lamp 22 is on, so that the coffin is illuminated. If the buried person wakens, he/she merely has to push the button 40 to initiate an audio and visual signal (flashing lights) at the transmitter 14 and the receiver 28, thereby alerting security or other personnel. If the transmitting structure is to be extracted, the reel 26*a* or motor is employed via roller housing 26 to roll up wires 24 so that the lamp 22 resides and is protected in the lamp box 16. As the shaft 12 is extracted, the metal appendages 36 will fold to close over lamp box 16 to afford further protection in order to prevent damage to the lamp 22. Also motion sensors (not shown) may be employed, whereby any movement inside the coffin will activate the transmitter 14.

It is to be understood that the present invention is not limited to the embodiments described above, but encompasses any and all embodiments within the scope of the following claims.

I claim:

1. A portable alarm system for coffins, comprising:

a hollow shaft having an upper end and a lower end;

a wireless transmitter for transmitting a signal disposed at the upper end of the hollow shaft;

a lamp box disposed at the lower end of the hollow shaft;

a lamp disposed in the lamp box, the lamp being extendable therefrom;

a plurality of wires connected to the lamp and extending through the hollow shaft;

a reel mechanism positioned in the hollow shaft and connected to the plurality of wires, whereby the plurality of wires may alternately be rolled up and extended through the hollow shaft and the lamp may alternately be extended from and retracted into the lamp box;

a motor for operating the reel mechanism; and a wireless receiver configured for receiving the signal transmitted by the wireless transmitter.

2. The portable alarm system for coffins according to claim 1, wherein said wireless transmitter is provided with an audible and a visual alarm.

3. The portable alarm system for coffins according to claim 1, wherein said wireless receiver is provided with an audible and a visual alarm.

4. The portable alarm system for coffins according to claim 1, wherein said lamp includes a switch for activating the wireless transmitter.

5. The portable alarm system for coffins according to claim 1, further including a plurality of appendages pivotally attached to said lamp box for pivoting movement thereon.

6. A portable alarm system for coffins, comprising:

a hollow shaft having an upper end and a lower end;

a wireless transmitter for transmitting a signal disposed at the upper end of the hollow shaft, the wireless transmitter having audible and visual alarms;

a lamp box disposed at the lower end of the hollow shaft;

a lamp disposed in the lamp box, the lamp being extendable therefrom;

a plurality of wires connected to the lamp and extending through the hollow shaft;

a reel mechanism positioned in the hollow shaft and connected to the plurality of wires, including means for operating the reel mechanism;

wherein the means for operating the reel mechanism is selected from a motor and a manually operated hand crank;

whereby the plural wires may alternately be rolled up and extended through the hollow shaft and the lamp may alternately be extended from and retracted into the lamp box by the wires;

whereby the lamp and the wireless transmitter are electrically connected via the plural wires; and a wireless receiver configured for receiving the signal transmitted by the wireless transmitter, the receiver having audible and visual alarms.

7. The portable alarm system for coffins according to claim 6, wherein said lamp includes a switch for activating the wireless transmitter.

8. The portable alarm system for coffins according to claim 6, further including a plurality of appendages pivotally attached to said lamp box for pivoting movement thereon.

9. The portable alarm system for coffins according to claim 6, wherein said visual alarms for said transmitter and said receiver are flashing lights.

10. A portable alarm system for coffins, comprising:

a hollow shaft having an upper end and a lower end;

a wireless transmitter for transmitting a signal disposed at the upper end of the hollow shaft, the wireless transmitter having audible and visual alarms, the visual alarm being flashing lights;

a lamp box disposed at the lower end of the hollow shaft;

a plurality of appendages pivotally attached to the lamp box for pivoting movement thereon;

a lamp disposed in the lamp box and being extendable therefrom;

wherein the plurality of appendages provide protection for the lamp housing and the lamp;

a plurality of wires connected to the lamp and extending through the hollow shaft;

a switch on the lamp for activating the wireless transmitter;

a reel mechanism positioned in the hollow shaft and connected to the plurality of wires, whereby the plurality of wires may alternately be rolled up and extended through the hollow shaft and the lamp may alternately be extended from and retracted into the lamp box by the wires;

means for operating the reel mechanism;

wherein the means for operating the reel mechanism is selected from a motor and a manually operated hand crank; and a wireless receiver for receiving the signal transmitted by the wireless transmitter, the receiver having audible and visual alarms, the visual alarm being flashing lights.

* * * * *